United States Patent [19]

Manning

[11] Patent Number: 4,777,874

[45] Date of Patent: Oct. 18, 1988

[54] ANTI-SPRINGBACK DEVICE FOR A CONTAINER

[75] Inventor: Douglas E. Manning, Knoxville, Tenn.

[73] Assignee: Phelps Engineering Company, Inc., Knoxville, Tenn.

[21] Appl. No.: 96,276

[22] Filed: Sep. 9, 1987

Related U.S. Application Data

[63] Continuation-in-part of Ser. No. 864,005, May 16, 1986, abandoned.

[51] Int. Cl.[4] ..... B30B 15/06

[52] U.S. Cl. ..... 100/220; 100/219; 100/95; 53/330; 53/486; 53/526; 220/323; 220/67; 376/272

[58] Field of Search ..... 100/54, 56, 58, 61, 100/219, 220, 57, 59, 187, 95; 53/330, 332, 526, 486; 252/633, 626; 206/449; 220/324, 326, 323, 67, 315, 316; 376/272

[56] References Cited

U.S. PATENT DOCUMENTS

| | | | |
|---|---|---|---|
| 1,270,201 | 6/1918 | Peterson | 100/61 |
| 1,886,803 | 11/1932 | Giesler | 220/67 X |
| 3,239,094 | 3/1966 | Henchert | 220/67 |
| 3,543,996 | 12/1970 | West | 220/67 |
| 4,414,788 | 11/1983 | Berg | 100/220 |
| 4,426,927 | 1/1984 | Teague | 100/219 |
| 4,564,469 | 1/1986 | Cochet et al. | 100/220 |

*Primary Examiner*—Andrew M. Falik

[57] ABSTRACT

A container used for compacting materials such as low level radioactive waste has a device used to keep the compacted material from springing out of the container when the compacting force is removed, thus resulting in a significant increase in the final compacted density. The device develops its restraining force by using the beam strength of its members. The device includes a louvre attached to the container, enabling the cross beams to be snapped into place with a wedge shape of the cross beam end or a hydraulic clamping device external to the container.

4 Claims, 4 Drawing Sheets

ANTI-SPRINGBACK DEVICE FOR A CONTAINER

This is a continuation in part of Ser. No. 06/864,005, filed May 16, 1986. Abandoned.

BACKGROUND OF THE INVENTION

1. Field of the Invention

The present invention relates to an anti-springback technique for increasing the densities achievable in a container by a compacting press.

2. Description of the Prior Art

When compacting material such as low level radioactive waste in a container, it is desirable to indefinitely leave the material in the container. Typically this type of waste has been placed in 55 gallon barrels and buried underground. The cost for burying such material is a function primarily of the volume and it becomes advantageous to achieve a high final compacted density. Recently, several manufacturers have developed box type containers for this purpose that enable a larger amount of waste to be more easily handled.

A problem arises when the compaction force is removed in that the material springs out of the container limiting the final compacted density. This becomes more of a problem when the compaction pressure is increased. One solution has been to place a thin sheet metal disk in a 55 gallon barrel during the final press compaction stroke. The disk will tend to be restrained by the inner sides of the barrel and will hold a light springback pressure.

When using large box type compactors the disk technique is not feasible. Using the container lid on the last stroke to press the material in the box becomes cumbersome and the pressure is limited to what the lid will withstand. U.S. Pat. No. 4,426,927 offers a holddown having pivotally connected members which can be rotated in place but is also cumbersome to insert and is limited to low pressures.

The present invention offers improvements in that it is easily snapped into place and can be made of sufficient strength to support higher springback pressures.

SUMMARY OF THE INVENTION

According to the present invention the springback problem is reduced by placing the anti-springback device on top of the waste during the final compaction stroke. The device may be further located by positioning grooves on the compacting machine platen. When the platen is lowered for the final stroke, the device lowers with it into the container and snaps in place to louvres located on the inside of the container walls. The beam strength of the anti-springback device members retains the compacted material in the container. The springback pressure prevents the device from coming out of the louvres. The container is sealed with a lid and the anti-springback device is left in place.

The primary advantage of the invention is the ease with which it can be placed and the strength of the design to retain higher springback pressures.

BRIEF DESCRIPTION OF DRAWINGS

In the drawings:

FIG. 6 is not taken from any other view but is similar to that shown by FIG. 5.

DETAILED DESCRIPTION

Figure 1:
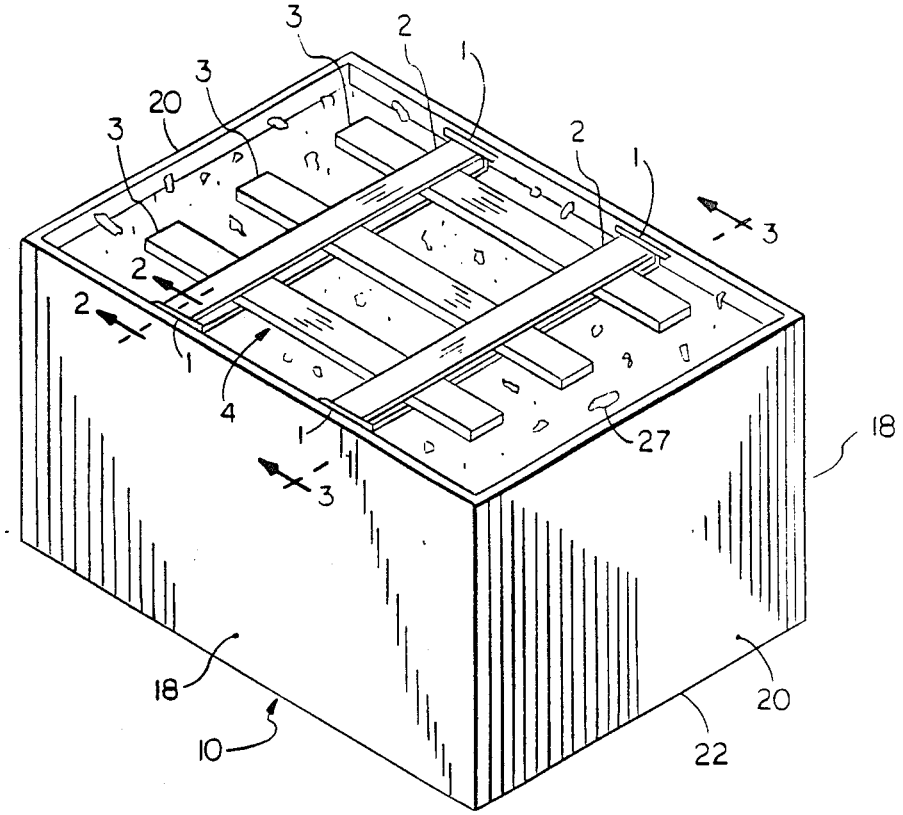
FIG. 1 is an perspective view of a waste container showing an anti-springback device in place.
Figure 2:
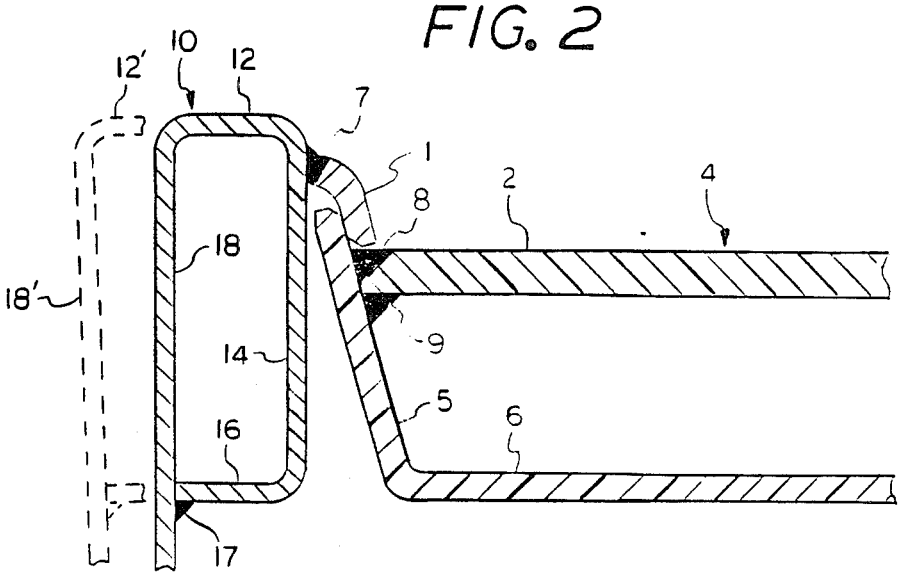
FIG. 2 is a sectional view taken from FIG. 1 and shows an anti-springback louvre with the cross beam being retained. The broken line shows the side of the container as it would appear spread apart to allow the device to be inserted.
Figure 3:
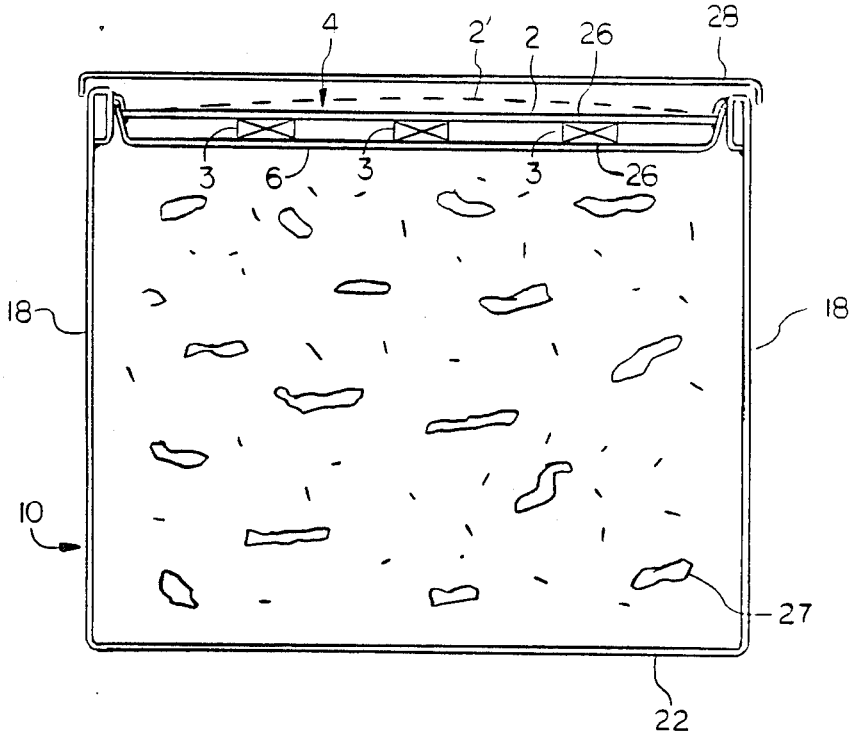
FIG. 3 is a sectional view taken from FIG. 1 showing the present invention in place. The broken line indicates deflection of the device as would appear when the compacting pressure is released. A sealing lid is also shown in this view.

With reference to FIGS. 1–3 a typical box type container 10 having sides 18, 20 and a bottom 22, is shown as it would appear with an anti-springback device 4 in place. Four louvres 1 are attached by weld 7 to the inside of the container 10 wall or top stiffening lip formed by members 12, 14, and 16. The end portion 16 is attached to the wall 18 by the weld 17. The cross members are composite beams which include steel metal bars 2,5,6 welded together 8,9 and may also be further strengthened by using wood, steel, or other material suitable to build a composite beam of the strength required for the application. Members 3 are used to provide additional retention of the compacted material 27 and may be fabricated from wood, metal, or other suitable material as either a single or composite beam to the required strength. In FIG. 3, members 3 may be connected to members 2,6 using suitable means 26 such as bolts, nails, rivets, and the like or may use friction only as a means to hold the relative positions. No specific connecting means is indicated by the drawing figures. It is not necessary to completely enclose the top of the compacted material 27 to retain typical types of waste material. An alternative embodiment would extend members 3 to the sides 20 of the container 10 and be fastened thereto similar to that illustrated by FIG. 2.

Figure 4:
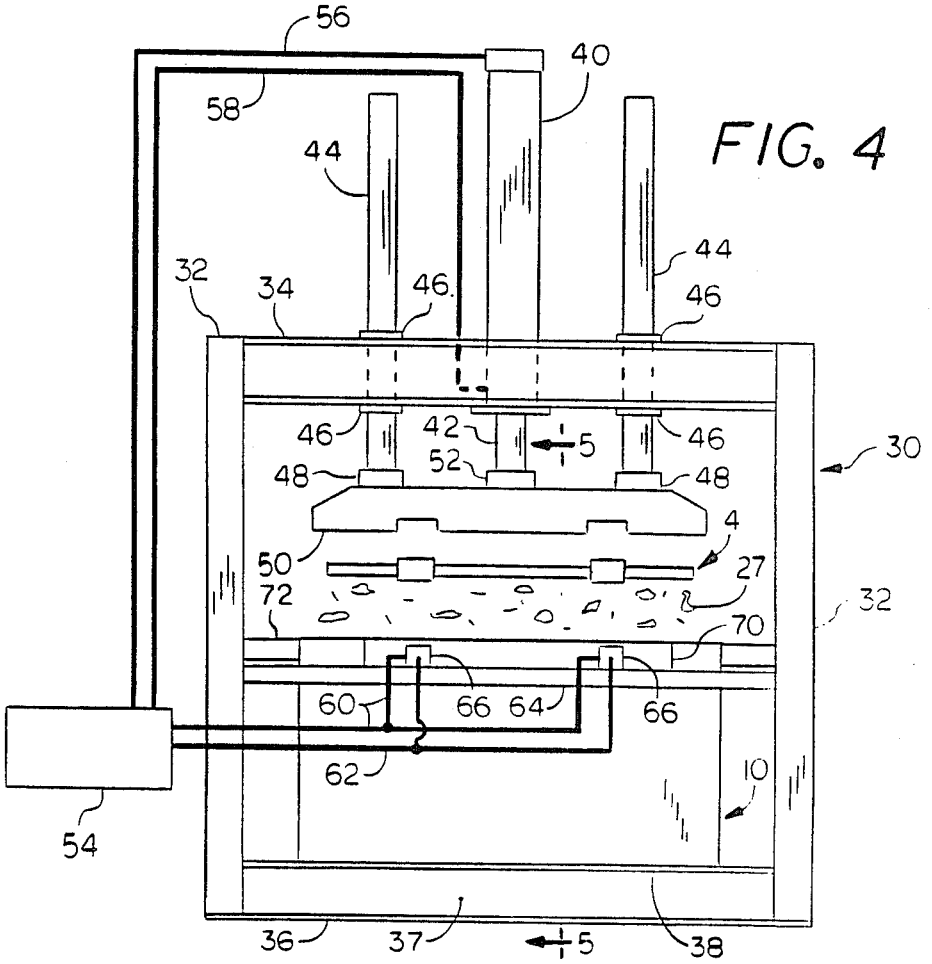
FIG. 4 is an elevational view of a compacting press having compacting means, a container, an anti-springback device, material to be compacted, and a container clamp used to assist the anti-springback device attachment.
Figure 5:
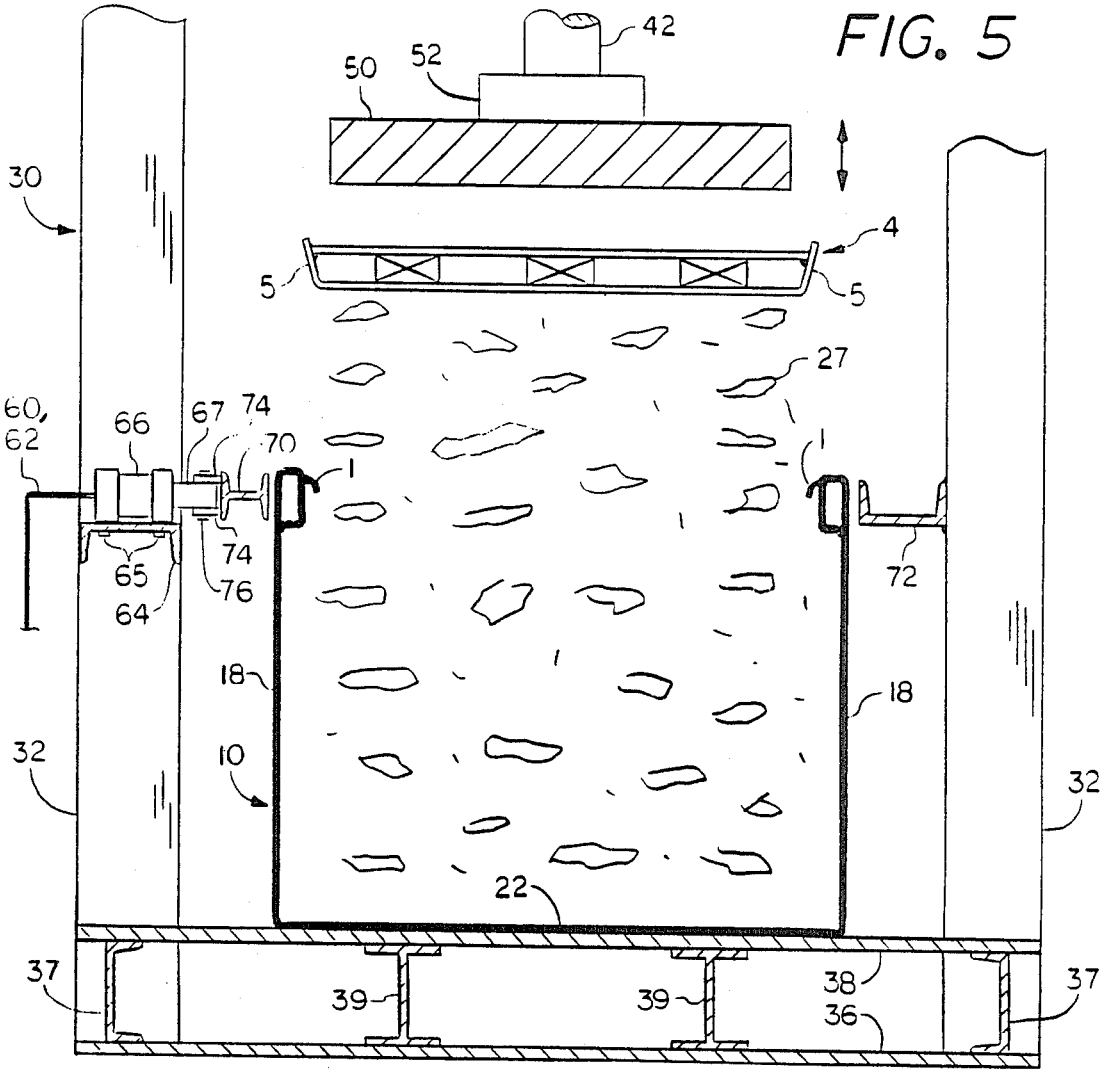
FIG. 5 is a sectional view taken from FIG. 4 showing further details of the press platen, anti-springback device as it would be placed to be inserted in the container, and the container clamp used to assist the anti-springback device attachment. The container clamp is shown retracted in this view to allow the container to spread apart by the wedge on the anti-springback device.

The device 4 is placed on top of the material 27 to be compacted at the last stroke of a compacting press 30 as illustrated by FIG. 4. In FIGS. 4–5, the compacting press 30 is illustrated as being constructed from members 32,34,36,37,38,39 and having compacting means comprising a standard commercially available hydraulic cylinder 40 with a cylinder rod 42 connected to a platen 50 with member 52. The platen 50 also having guide means comprising rods 44 and bushings 46 connected to the platen 50 by members 48. The compacting press 30 is operated by a standard commercially available fluid pressurizing means 54 through lines 56,58. Grooves or other locaters are incorporated with the compacting press 30 that allow the device 4 to be correctly positioned over the louvres 1. When the compacting press platen 50 is lowered the angle of the end of the cross beams 2,5 forms a wedge which will contact the louvres 1 and force the sides 18 and top edge 12 of the container 10 outward, as illustrated by the broken lines 18' and 12' on FIG. 2, until the engaging bars 5 are lowered below the louvres 1. The sides 18 of the container 10 then spring back inward as a result of the resilience of the structural stiffener formed from the container 10 sides illustrated by FIG. 2.

Figure 6:
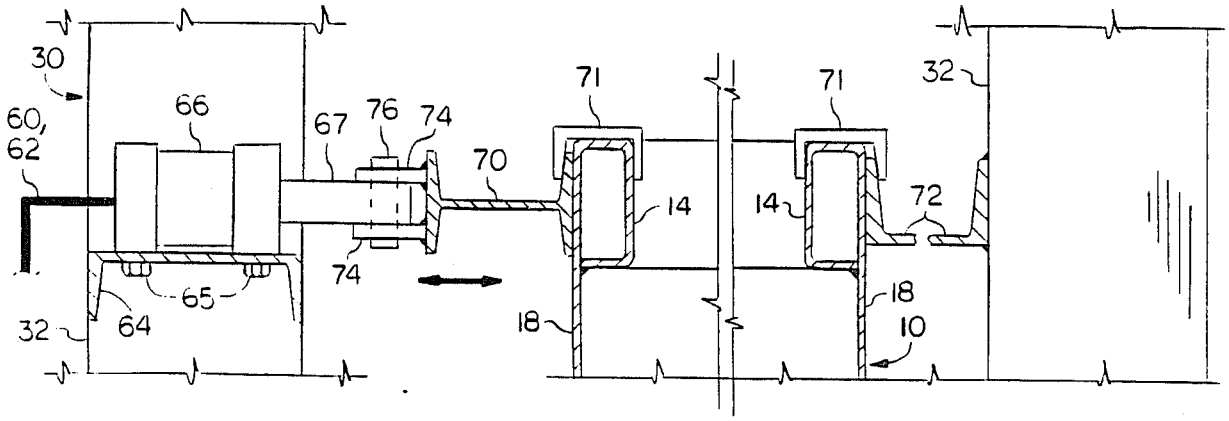
FIG. 6 is a sectional view showing detals of a container clamp which could be used to assist the anti-springback device attachment. The clamp is shown pressing against the container in this view. Clips over the container and clamps are also shown which is an alternate means for spreading the container sides apart allowing insertion of the anti-springback device.

A clamping device common on container presses may also be used to push the container 10 sides back inward. In FIGS. 4–6 a typical clamping means is indicated as being attached to the compacting press 30 by channel 72, structural beam 70, brackets 74, pings 76, cylinder rods 67, standard industrial type hydraulic cylinders 66, bolted 65 to a channel 64, and operated by the standard commercially available fluid pressurizing means 54 through lines 60,62. When the cylinder rods 67 are extended towards the container 10, the container 10 will be pressed between members 70, 72 forcing the sides 18 back inward. This technique may be used to assist or in lieu of the resilience of the container walls 18 as a means for returning the sides 18 of the container 10 inward.

The compacting press platen 50 is then raised and the extension of steel bar 5 is forced between the stiffening lip 14 and louvre 1, as illustrated by FIG. 2 and held is in place by the spring pressure of the compacted material 27 as illustrated by FIG. 3. Broken line 2' on FIG. 3 indicates upward deflection of the device 4 that can be expected when the compacting force is removed and the device 4 is pressed upward by the pressure of the compacted material 27. The device 4 is not easily removed and is usually used on containers where it is intended to be left in place. The device 4 has the additional advantage of keeping the sides 18 of the container 10 straight allowing easier attachment of a sealing lid 28 as illustrated by FIG. 3.

A modification of the above spreading procedure could consist of externally pulling the container 10 sides outward without the wedge of bar 5. In FIG. 6 brackets 71 are shown as they could be placed adjacent to the louvres 1 and over the stiffening lip 14 and container clamp members 72,70. When the cylinder rods 67 are retracted away from the container 10, the sides 18 are spread outward by the clips 71 to a position as shown by 18' of FIG. 2 for allowing the bars 5 to be lowered below the louvres 1.

Figure 7:
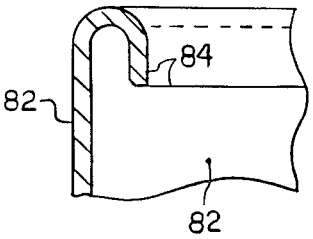
FIG. 7 is a sectional view of an alternative louvre embodiment.
Figure 8:
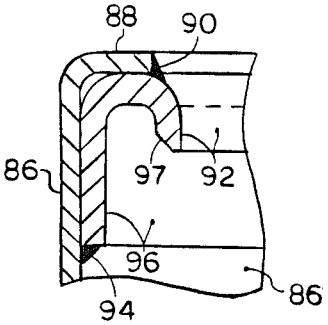
FIG. 8 is a sectional view of an alternative louvre embodiment.
Figure 9:
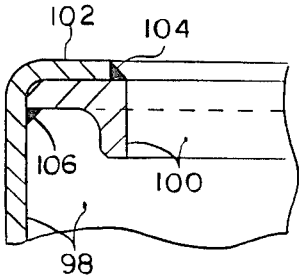
FIG. 9 is a sectional view of an alternative louvre embodiment.

Alternative embodiments of the louvre design are illustrated by FIGS. 7–8. FIG. 7 illustrates a cross section taken through a louvre that is formed by rolling a container side wall 82 over to form the louvre 84. FIG. 8 is a sectional view that illustrates a container wall 86 bent to form a sealing surface 88, and welded 90,94 to a formed member 96 that has the louvre 92. A chamfer 97 is typically used to assist the engaging operation. FIG. 9 illustrates a similar design to that of FIG. 8 and has a container wall 98, bent to form a sealing surface 102, and welded 104,106 to a formed louvre member 100. The louvre designs of FIGS. 7–9 may be used to form a stiffening lip around the perimeter of the container top. Either of the embodiments of FIGS. 7–9 could be used to achieve the function as that of louvre 1 as illustrated in FIG. 2.

Figure 10:
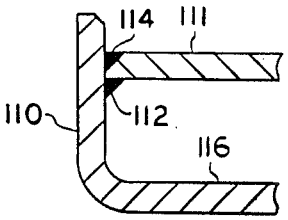
FIG. 10 is a sectional view of an alternative engaging bar embodiment.
Figure 11:
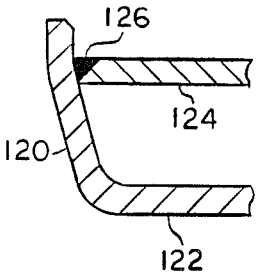
FIG. 11 is a sectional view of an alternative engaging bar embodiment.
Figure 12:
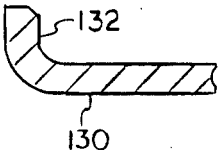
FIG. 12 is a sectional view of an alternative engaging bar embodiment.

FIGS. 10–12 illustrate alternative embodiments of the bars that engage the louvres. FIG. 10 illustrates a sectional view of a bar 110 bent from member 116 that is welded 112,114 to a composite beam member 111. The embodiment of FIG. 10 is similar to that illustrated by 2,4,5,6,8, and 9 of FIG. 2 with the exception that no wedge is generated by the angle of bar 110. This embodiment could typically be used when alternative spreading means for the container sides were used such as brackets 71 of FIG. 6. FIG. 11 illustrates a sectional view of a bar 120 that is bent from member 122 and welded 126 to member 124 to form a composite beam. The embodiment of FIG. 11 is also similar to that illustrated by 2,4,5,6,8, and 9 of FIG. 2 with the exception that a single weld 126 may be used and the bar 120 is further bent vertically to allow better engagement with the louvre embodiments of FIGS. 7–9. FIG. 12 is a sectional view of a simple engaging bar 132 that is formed from a single beam member 130. The embodiment of FIG. 12 could also be formed from a plate that would extend along the side of a container and engage a louvre design of FIGS. 7–9, the plate would be considered as a plurality of elongated members connected together.

Figure 13:
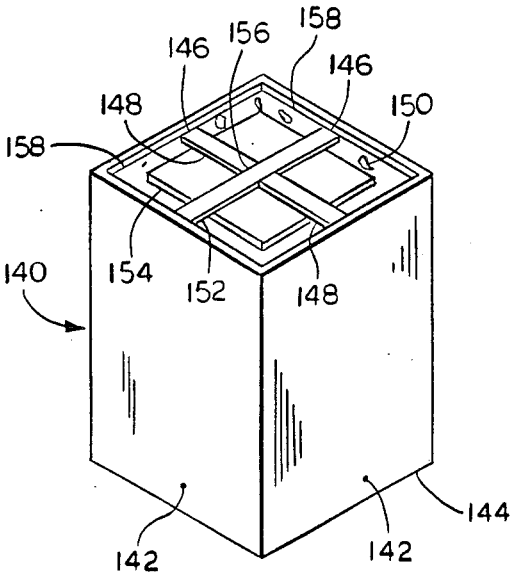
FIG. 13 is a perspective view of a generally square container having anti-springback members that are arranged perpendicularly to engage the walls. A planar member is also used to assist in restraining the compacted material.

FIG. 13 illustrates a container 140 having walls 142 and a bottom 144. The louvres 158 could be of either of the mentioned embodiments. The engaging bars 146 connected to support members 152 and 148 could also be either of the mentioned embodiments and have connecting means 156 to attach to the perpendicular container walls 142. A planar member 154 may be used to assist in restraining the compacted material 150.

Figure 14:
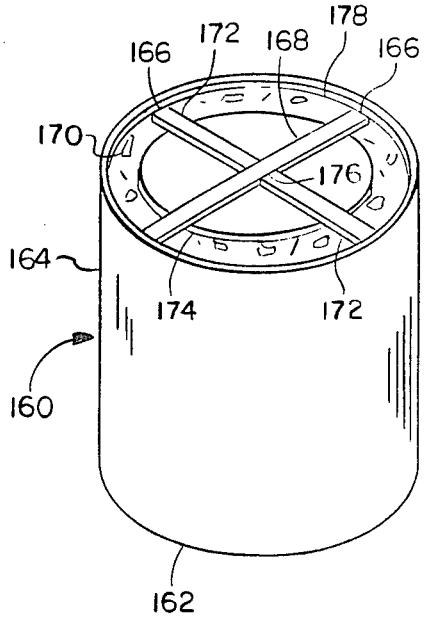
FIG. 14 is a perspective view of a generally round barrel type container having anti-springback members that are arranged perpendicularly to engage the walls. A planar member is also used to assist in restraining the compacted material.

FIG. 14 is similar to FIG. 13 with the exception that the plurality of oppositely opposed container walls 164 are generated from a generally round barrel configuration. The container 160 otherwise has the same features as FIG. 13 including a bottom 162, engaging bars 166, cross members 168,172 that have connecting means 176, and a planar member 174 that may be used to assist in restraining the compacted material 170. The plurality of louvres 178 may be separately spaced or generated by the embodiments of FIGS. 7–9 around the perimeter of the container 160 top.

Figure 15:
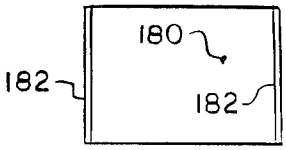
FIG. 15 is a plan view of a generally rectangular shaped planar anti-springback device having upturned edges that form engaging bars similar to FIG. 12 that can fit in the louvre embodiments of either FIGS. 7–9.

FIG. 15 is an alternative embodiment of an anti-springback device that is fabricated from a planar member 180 such as a metal plate, and has upturned edge members that form a plurality of engaging bars 182. A sectional view taken through the engaging bars would appear similar to FIG. 12. This embodiment could be used in a square or retangular shaped container having louvres along two sides similar to the louvre embodiments illustrated in FIGS. 7–9.

Figure 16:
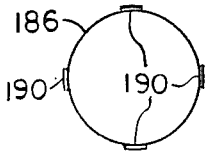
FIG. 16 is a plan view of a generally round shaped planar anti-springback device and has a plurality of engaging bars similar to FIG. 12 that could fit a barrel type container such as FIG. 14.

FIG. 16 is an alternative embodiment of an anti-springback device that is also fabricated from a planar member 186 such as a metal plate, and has upturned edge members that form a plurality of engaging bars 190. A sectional view taken through the engaging bars would appear similar to FIG. 12. This embodiment could be used in a barrel of generally round shaped container having louvres around the perimeter similar to the louvre embodiments illustrated in FIGS. 7–9.

The foregoing descriptions of the anti-springback device may be used with compacted low level radioactive waste material.

From the foregoing description of the operation of the anti-springback device, it should be apparent that an invention is described which provides a technique for effectively keeping compacted material from springing back out of a container when the compaction force is removed.

Having illustrated and described what is presently the preferred embodiments of the invention it should be apparent to those skilled in the art that the preferred embodiments may be modified in arrangement and detail without departing from the principles of the invention which are intended to be illustrated but not limited by the disclosure. We therefore claim as our invention all such modifications as come within the true spirit and scope of the following claims:

We claim:

1. In a system for handling and storing material, said system having compacting means, said material further having springback pressure when compacted, an improved device for keeping said material from springing back when the compacting force is removed, wherein the improvement comprises:

a container having a plurality of oppositely opposed sides, a bottom, an open top including an edge; and a plurality of louvres attached to inside surfaces of said sides below the edge of said container, each of said louvres comprising a member extending in a generally downward direction;

means for restraining the compacted material comprising: a plurality of elongated members, each of said elongated members having a first and second end portion, each of said elongated members further crossing at least one other said elongated member in a generally perpendicular direction; and a plurality of engaging bars attached to said first and second end portions of at least two of said elongated members, each of said engaging bars comprising a member extending in a generally upward direction;

means for spreading the sides of said container outward for allowing said engaging bars to be lowered by said compacting means below said louvres; and means for returning the sides of said container inward for allowing said engaging bars to be held in place by said louvres when said elongated members are located underneath said louvres and forces upward by said springback pressure of the compacted material wherein the entire said plurality of elongated members and their associated engaging bars are held in place by the springback pressure of said material.

2. In a system for handling and storing material, said system having compacting means, said material further having springback pressure when compacted, an improved device for keeping said material from springing back when the compacting force is removed, wherein the improvement comprises:

a container having a plurality of oppositely opposed sides, a bottom, an open top including an edge, and a plurality of louvres attached to inside surfaces of said sides below the edge of said container, each of said louvres comprising a member extending in a generally downward direction;

means for restraining the compacted material comprising: a planar member having a first an second end portion and engaging bars attached to said first and second end portions of said planar member, each of said engaging bars comprising a member extending in a generally upward direction;

means for spreading the sides of said container outward for allowing said engaging bar to be lowered below said louvres; and means for returning the sides of said container inward for allowing said engaging bars to be held in place by said louvres when said engaging bars are located underneath said louvres and forced upward by said springback pressure of the compacted material wherein the entire said planar member and its associated engaging bars are held in place by the springback pressure of said material.

3. The invention of claims 1 or 2 wherein said means for spreading the sides of said container outward comprises a wedge shape on said first and second end portions.

4. The invention of claims 1 or 2, in combination with low level radioactive waste material.

* * * * *